US011703269B2

(12) United States Patent
Bo et al.

(10) Patent No.: US 11,703,269 B2
(45) Date of Patent: Jul. 18, 2023

(54) REFRIGERATOR

(71) Applicant: BSH HAUSGERAETE GMBH, Munich (DE)

(72) Inventors: Tao Bo, Nanjing (CN); Siting Ren, Nanjing (CN); Xun Wang, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 84 days.

(21) Appl. No.: 17/214,166

(22) Filed: Mar. 26, 2021

(65) Prior Publication Data

US 2021/0310289 A1 Oct. 7, 2021

(30) Foreign Application Priority Data

Apr. 3, 2020 (CN) ..... 202010257733.9

(51) Int. Cl.
*F25D 23/02* (2006.01)
*E05D 11/06* (2006.01)
*E05D 11/10* (2006.01)

(52) U.S. Cl.
CPC ..... *F25D 23/028* (2013.01); *E05D 11/06* (2013.01); *E05D 11/1028* (2013.01); *E05Y 2900/31* (2013.01)

(58) Field of Classification Search
CPC ... E05D 11/06; E05D 11/1028; F25D 23/028; F25D 2323/021; F25D 23/025; F25D 2400/06; E05Y 2900/31; Y10T 16/5398; Y10T 16/539; Y10T 16/53987; Y10T 16/551; E05F 5/06
See application file for complete search history.

(56) References Cited

U.S. PATENT DOCUMENTS 2,619,673 A * 12/1952 Evans ..... E05D 11/1014 16/386
5,566,739 A * 10/1996 Hoffman ..... E05D 1/04 160/183
5,881,431 A * 3/1999 Pieper, II ..... E05D 11/06 16/374
9,234,695 B1 * 1/2016 Dubina ..... F25D 23/028
2002/0133909 A1 * 9/2002 Apostoloff ..... E05C 17/025 16/375
2006/0260097 A1 * 11/2006 Tate ..... E05D 3/022 16/309

(Continued)

FOREIGN PATENT DOCUMENTS

CN 203274419 U * 11/2013 ..... F25D 23/02
CN 104266443 A * 1/2015 ..... F25D 23/028
CN 105352250 A * 2/2016 ..... F25D 23/028

*Primary Examiner* — Hiwot E Tefera
(74) *Attorney, Agent, or Firm* — Laurence A. Greenberg; Werner H. Stemer; Ralph E. Locher

(57) ABSTRACT

A refrigerator includes a cabinet provided with a storage compartment, a door capable of opening and closing the storage compartment, a turning plate and a hinge assembly including a hinge moving member and a hinge fixed member connecting the door to the turning plate. One of the hinge moving member or the hinge fixed member defines a trajectory having a first end portion and a second end portion. The other of the hinge moving member or the hinge fixed member has a limiting portion adapted to rotate between the first end portion and the second end portion along the trajectory.

11 Claims, 10 Drawing Sheets

(56) References Cited

U.S. PATENT DOCUMENTS

| | | | | |
|---|---|---|---|---|
| 2009/0100641 | A1* | 4/2009 | Yang | E05D 11/1078 16/303 |
| 2010/0125977 | A1* | 5/2010 | Shen | G06F 1/1681 16/374 |
| 2012/0124776 | A1* | 5/2012 | McDonnell | E05D 11/06 16/375 |
| 2013/0021726 | A1* | 1/2013 | Yang | H04M 1/0216 361/679.01 |
| 2013/0067687 | A1* | 3/2013 | Mitchell | E05F 1/066 16/312 |
| 2013/0104345 | A1* | 5/2013 | Cranberry | E05D 11/06 16/374 |
| 2013/0237328 | A1* | 9/2013 | Billings | E05D 11/1028 464/37 |
| 2014/0159560 | A1* | 6/2014 | Jung | F25D 23/028 312/405 |
| 2014/0259532 | A1* | 9/2014 | Millard | E05D 11/1028 16/326 |
| 2018/0030766 | A1* | 2/2018 | Yeom | E05D 3/02 |
| 2019/0112853 | A1* | 4/2019 | Mccafferty | E05D 11/06 |
| 2019/0170427 | A1* | 6/2019 | Baum | F25D 23/02 |
| 2019/0186186 | A1* | 6/2019 | Tamer | E05D 11/06 |
| 2020/0363122 | A1* | 11/2020 | Park | F25D 23/025 |

* cited by examiner

REFRIGERATOR

CROSS-REFERENCE TO RELATED APPLICATION

This application claims the priority, under 35 U.S.C. § 119, of Chinese Patent Application CN 2020 1025 7733.9, filed Apr. 3, 2020; the prior application is herewith incorporated by reference in its entirety.

BACKGROUND OF THE INVENTION

Field of the Invention

The present invention relates to home appliances, and in particular, to a refrigerator.

Some refrigerators use a turning plate adapted to improve leak-proofness of a door during closing. When the door is opened, the turning plate needs to turn about a certain angle, and in the turning process, it may strike hanging parts (such as a door shelf) on the door, causing damage to the hanging parts, or making noise. The existing solutions to that problem influence aesthetics and/or increase part costs.

BRIEF SUMMARY OF THE INVENTION

It is accordingly an object of the invention to provide an improved refrigerator, which overcomes the hereinaforementioned disadvantages of the heretofore-known refrigerators of this general type.

With the foregoing and other objects in view there is provided, in accordance with the invention, a refrigerator including a cabinet provided with a storage compartment, a door capable of opening and closing the storage compartment, a turning plate, and a hinge assembly including a hinge moving member and a hinge fixed member connecting the door to the turning plate, one of the hinge moving member or the hinge fixed member defining a trajectory having a first end portion and a second end portion, and the other of the hinge moving member or the hinge fixed member having a limiting portion adapted to rotate between the first end portion and the second end portion along the trajectory.

In some embodiments, one of the hinge moving member or the hinge fixed member includes a receiving groove in communication with the trajectory, the other of the hinge moving member or the hinge fixed member includes a body portion accommodated in the receiving groove, and the limiting portion protrudes into the trajectory from the body portion.

In some embodiments, the receiving groove includes a receiving space having a cross section which is fan-shaped, and the trajectory includes a limiting space having a cross section which is ring-like.

In some embodiments, the first end portion and the second end portion are respectively connected to the receiving space.

In some embodiments, an outer ring diameter of the ring-like cross section of the limiting space is greater than a diameter of the fan-shaped cross section of the receiving space.

In some embodiments, the body portion is cylindrical, and the limiting portion is a rib on the body portion.

In some embodiments, the body portion is internally hollow.

In some embodiments, one of the hinge moving member or the hinge fixed member includes a first butting portion provided with the trajectory and the receiving groove, and the other of the hinge moving member and the hinge fixed member includes a second butting portion abutted against the first butting portion.

In some embodiments, the body portion and the limiting portion extend from the second butting portion to the first butting portion.

In some embodiments, the first butting portion includes a first butting surface, and the second butting portion includes a second butting surface abutted against the first butting surface.

In some embodiments, the first butting surface and the second butting surface are mutually fitting curved surfaces.

In some embodiments, the body portion and the limiting portion are smaller in size than the second butting portion.

In some embodiments, the hinge fixed member includes the trajectory, and the hinge moving member includes the limiting portion.

If technical conditions permit, the subject matter claimed by any independent claim in the present application can be combined with a single subject matter claimed by any dependent claim or a combination of a plurality of subject matters claimed by any dependent claims to form a novel subject matter.

The present invention will be further described below with reference to the accompanying drawings. The same or similar reference signs are used in the figures to denote the same or similar elements, shapes, and structures in different embodiments, and descriptions of the same or similar elements, shapes, and structures in different embodiments, and descriptions of elements, shapes, structures, features, and effects in the prior art may alternatively be omitted.

Other features which are considered as characteristic for the invention are set forth in the appended claims.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
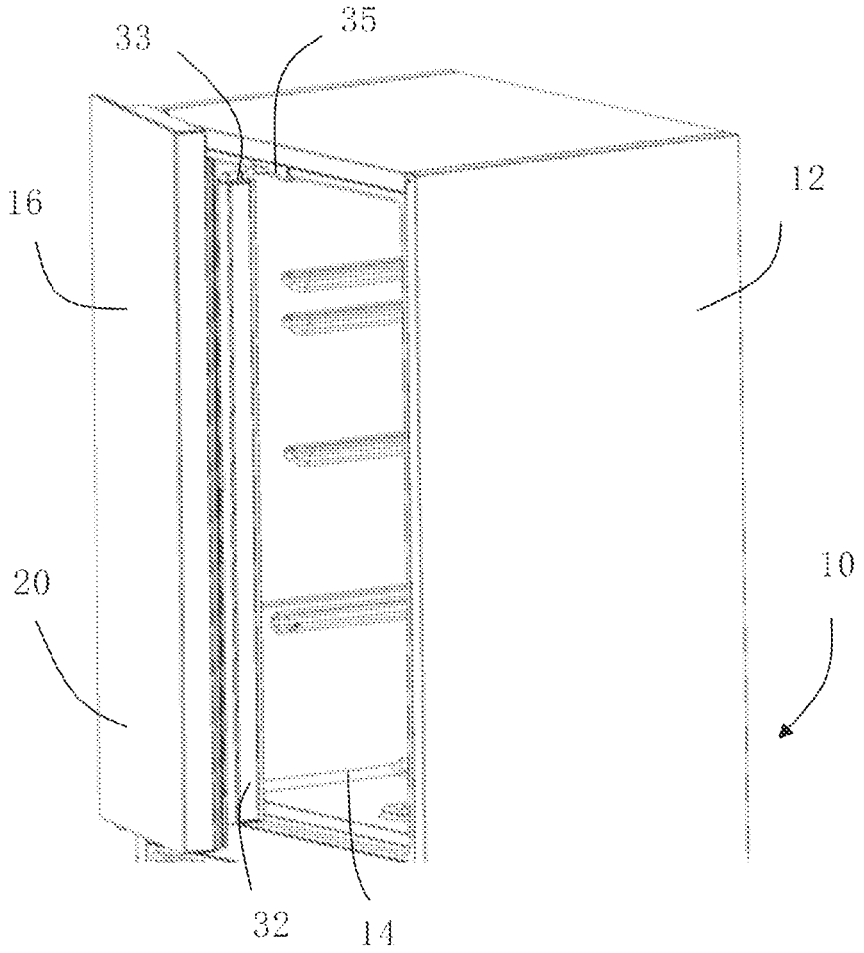
FIG. 1 is a diagrammatic local perspective view of a refrigerator according to some embodiments of the invention, where a right side door is omitted.
Figure 7:
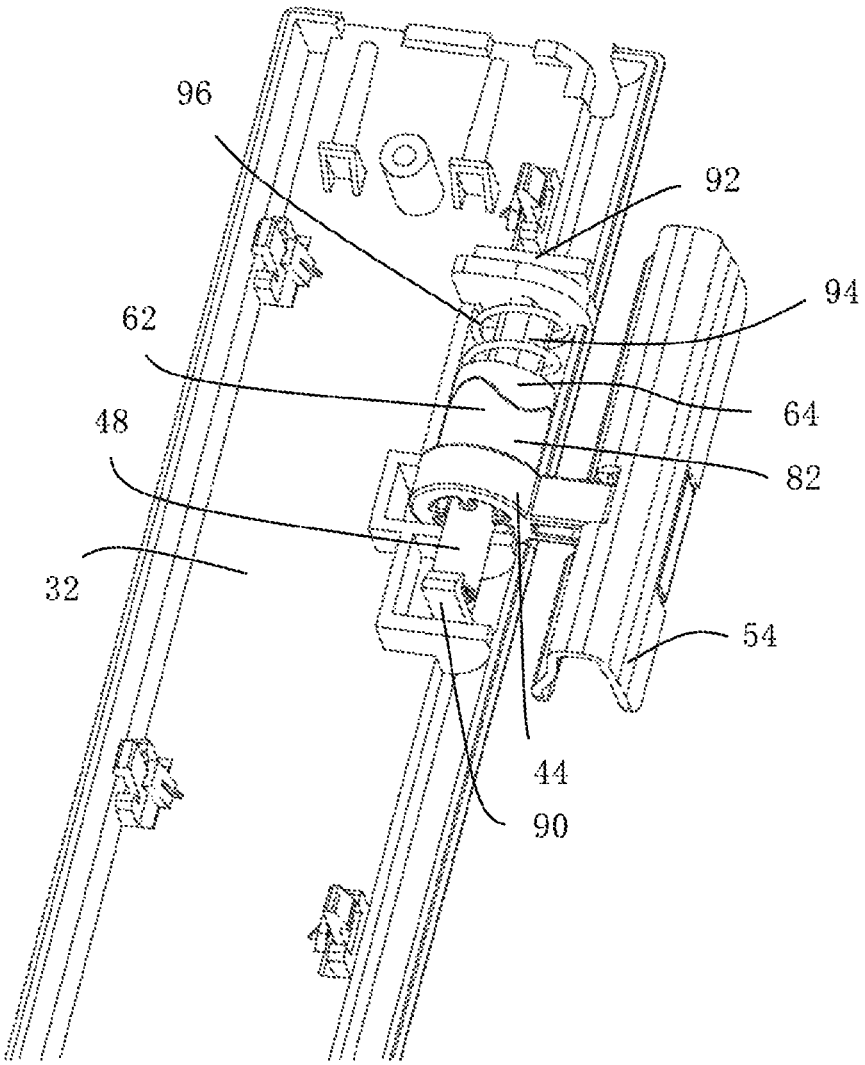
FIG. 7 is a diagrammatic local assembly view of a turning plate of the refrigerator in FIG. 1.
Figure 8:
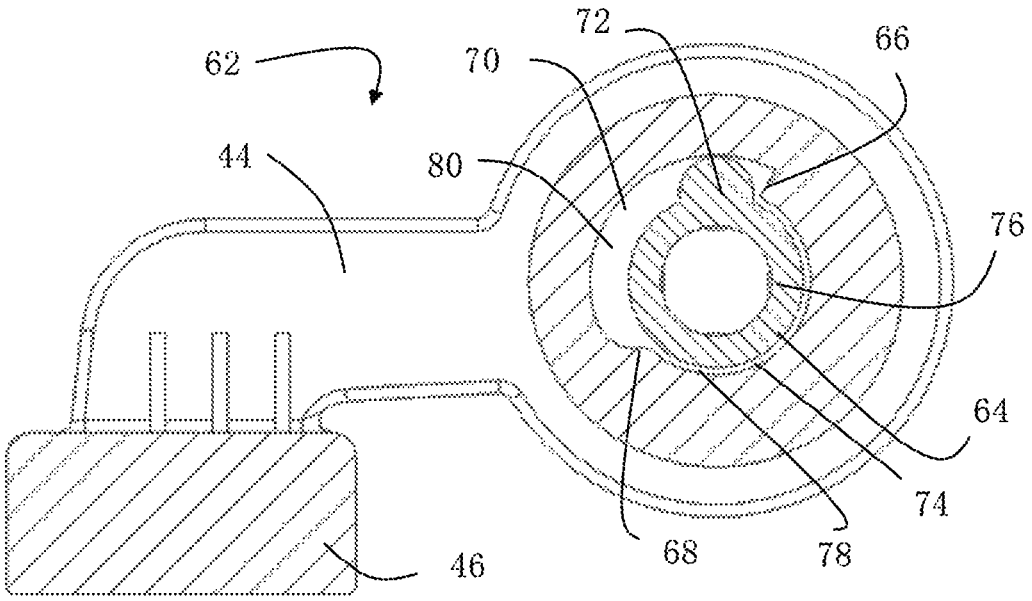
FIG. 8 is a diagrammatic sectional view of a hinge assembly of the refrigerator in FIG. 1.

Referring now in detail to the figures of the drawings and first, particularly, to FIG. 1, FIG. 7 and FIG. 8 thereof, it is seen that an aspect of the embodiments of the present invention relates to a refrigerator 10, including a cabinet 12 provided with a storage compartment 14.

The refrigerator 10 includes a door 16 capable of opening and closing the storage compartment 14.

The refrigerator 10 includes a turning plate 32. The turning plate 32 is connected to the door 16. The turning plate 32 is rotatably connected to the door 16 to seal a gap between the door 16 and another door (not shown) adjacent to the door 16.

The refrigerator 10 includes a hinge assembly 62. The hinge assembly 62 includes a hinge moving member 64 and a hinge fixed member 44 connecting the door 16 to the turning plate 32. One of the hinge moving member 64 and the hinge fixed member 44 defines a trajectory 70 including a first end portion 66 and a second end portion 68, and the other one of the hinge moving member 64 and the hinge fixed member 44 includes a limiting portion 72 adapted to rotate between the first end portion 66 and the second end portion 68 along the trajectory 70.

The refrigerator 10 may be of any suitable type. The cabinet 12, the storage compartment 14 and the door 16 may have any suitable shape and configuration, etc. More than two doors 16 may exist and may be disposed side by side. FIG. 1 omits the door at the right side (not shown) to more clearly present a position relation between the door 16 and the turning plate 32. In the refrigerator 10, leak-proofness between the adjacent doors 16 when closing the doors 16 can be improved by using the turning plate 32.

In the process of opening or closing the door 16, it matches with a guide portion 33 of an end portion of the turning plate 32 and a guide structure 35 on the cabinet 12 to drive the turning plate 32 to rotate. When the turning plate 32 rotates, the hinge moving member 64 rotates with the turning plate 32 at the same time. When it is rotated to a designated maximum position, the limiting portion 72 is abutted against one of the first end portion 66 and the second end portion 68, and the turning plate 32 can no longer rotate, so that a possibility for the turning plate 32 to strike other parts (for example, a door shelf, not shown) on the door 16 is significantly reduced. When the turning plate 32 striking other parts of the door 16 is avoided or the frequency thereof is reduced, a possibility of making noises is significantly reduced, and at the same time, the service life of the refrigerator 10 can be prolonged. In addition, controlling a turning angle of the turning plate 32 by using the hinge assembly 62 facilitates the condition of neither influencing aesthetics nor significantly increasing part costs.

In some embodiments, one of the hinge moving member 64 and the hinge fixed member 44 includes a receiving groove 74 in communication with the trajectory 70, the other one of the hinge moving member 64 and the hinge fixed member 44 includes a body portion 76 accommodated in the receiving groove 74, and the limiting portion 72 protrudes into the trajectory 70 from the body portion 76. The body portion 76 may rotate in the receiving groove 74, so as to drive the limiting portion 72 to rotate along the trajectory 70, which facilitates the condition of neither influencing aesthetics nor increasing part costs.

Figure 9:
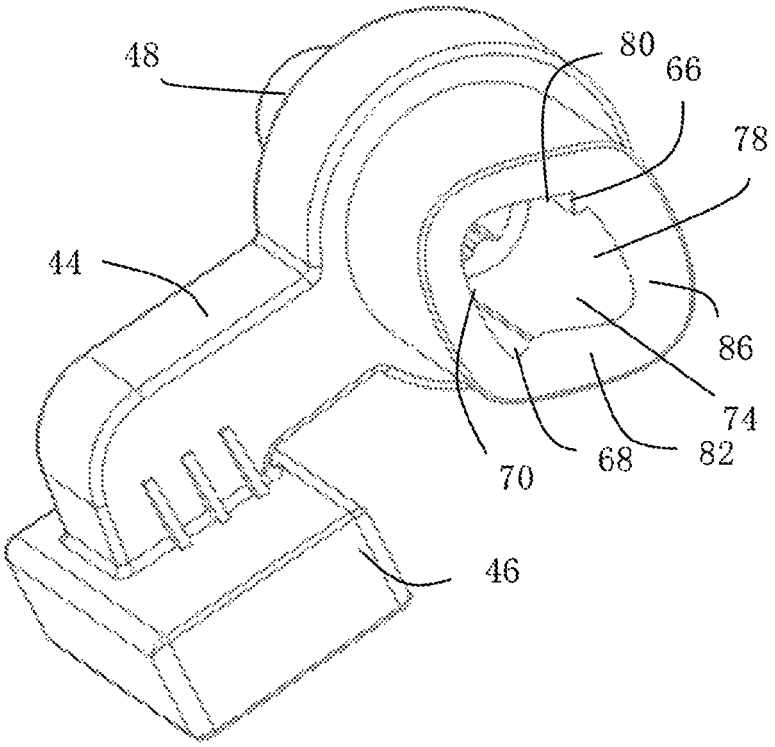
FIG. 9 is a diagrammatic perspective view of a hinge fixed member of the hinge assembly in FIG. 8.

The receiving groove 74 and the trajectory 70 may have any suitable shape and configuration, etc. Additionally, referring to FIG. 9, in some embodiments, the receiving groove 74 includes a receiving space 78 having a cross section which is fan-shaped. The trajectory 70 includes a limiting space 80 having a cross section which is ring-like. In this way, it facilitates the body portion 76 to be accommodated in the receiving space 78 and the limiting portion 72 to protrude into the limiting space 80 from the body portion 76. In some embodiments, the first end portion 66 and the second end portion 68 are separately connected to the receiving space 78. In this way, it facilitates controlling the movement of the limiting portion 72 to the trajectory 70 so as to limit the turning range of the turning plate 32.

In some embodiments, an outer ring diameter of the ring-like cross section of the limiting space 80 is greater than a diameter of the fan-shaped cross section of the receiving space 78. In this way, it facilitates the body portion 76 to be accommodated in the receiving space 78 and the limiting portion 72 to protrude into the limiting space 80 from the body portion 76. The size of the body portion 76 may be smaller than or equal to the diameter of the fan-shaped cross section of the receiving space 78, and the size of the limiting portion 72 may be smaller than or equal to a difference between diameters of the outer and inner rings of the limiting space 80.

Figure 10:
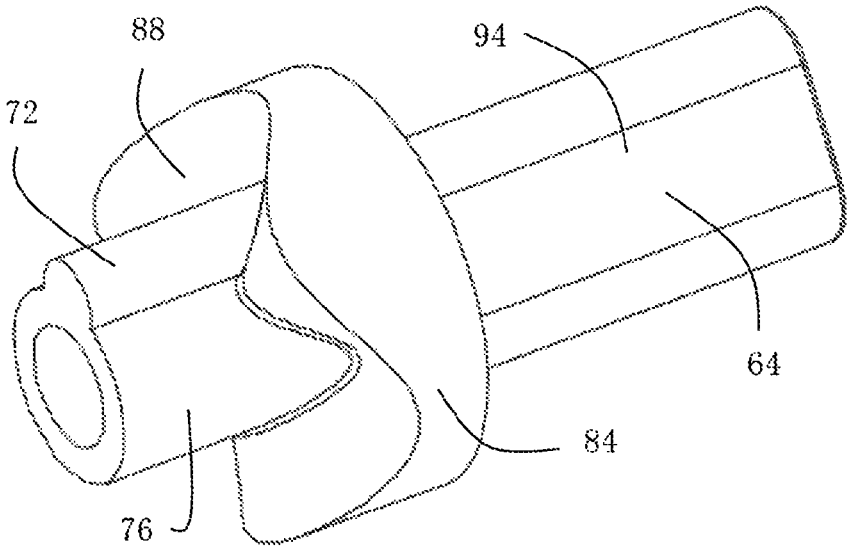
FIG. 10 is a diagrammatic perspective view of a hinge moving member of the hinge assembly in FIG. 8.

The body portion 76 and the limiting part 72 may have any suitable shape and configuration, etc. As shown in FIG. 10, in some embodiments, the body portion 76 is cylindrical, and the limiting portion 72 is a rib on the body portion 76. In this way, it facilitates the body portion 76 to drive the limiting part 72 to rotate.

In some embodiments, the body portion 76 is internally hollow. The internally hollow body portion 76 may facilitate reducing the weight of the hinge assembly 62, and enable the body portion 76 to have a certain elasticity, so as to have a certain margin when assembling with the receiving space 78.

In some embodiments, one of the hinge moving member 64 and the hinge fixed member 44 includes a first butting portion 82 provided with the trajectory 70 and the receiving groove 74, and the other one of the hinge moving member 64 and the hinge fixed member 44 includes a second butting portion 84 abutted against the first butting portion 82. The abutting between the first butting portion 82 and the second butting portion 84 may facilitate the matching between the trajectory 70 and the limiting portion 72 and the matching between the receiving groove 74 and the body portion 76.

In some embodiments, the body portion 76 and the limiting portion 72 extend from the second butting portion 84 to the first butting portion 82. In this way, it facilitates the matching between the trajectory 70 and the limiting portion 72 and the matching between the receiving groove 74 and the body portion 76 when the second butting portion 84 is abutted against the first butting portion 82.

In some embodiments, the first butting portion 82 has a first butting surface 86, and the second butting portion 84 has a second butting surface 88 abutted against the first butting surface 86. The abutting between the first butting surface 86 and the second butting surface 88 may facilitate matching in all aspects between the hinge moving member 64 and the hinge fixed member 44.

In some embodiments, the first butting surface 86 and the second butting surface 88 are mutually fitting curved surfaces. In this way, it facilitates the reliability of the combination between the first butting surface 86 and the second butting surface 88.

In some embodiments, the body portion 76 and the limiting portion 72 are smaller in size than the second butting portion 84. In this way, it facilitates the body portion 76 and the limiting portion 72 to be accommodated in the receiving groove 74 and the trajectory 70; the movement would not be easily interfered by accommodation, the appearance is not influenced, and the part costs are not increased.

The trajectory 70 and the limiting portion 72 as well as other corresponding shapes and configurations, etc. can be respectively located at any one of the hinge fixed member 44 and the hinge moving member 64. In some embodiments, the hinge fixed member 44 includes the trajectory 70, and the hinge moving member 64 includes the limiting portion 72. In this way, during moving, the hinge moving member 64 may drive the limiting portion to rotate in the trajectory 70 of the hinge fixed member 44.

Figure 2:
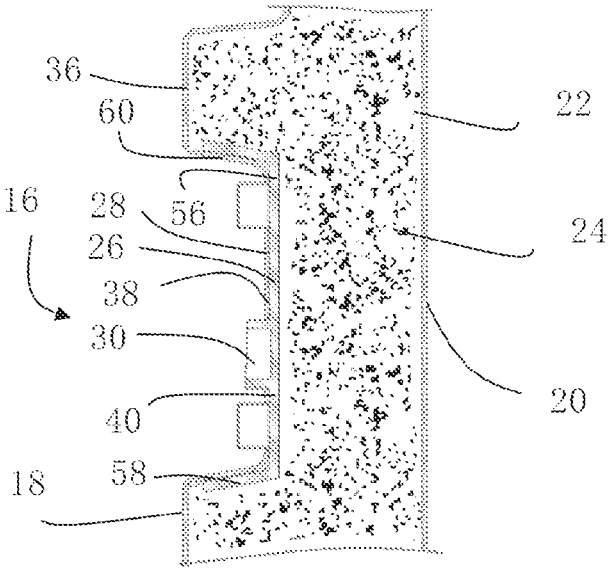
FIG. 2 is a diagrammatic local sectional view of a door of the refrigerator in FIG. 1.
Figure 3:
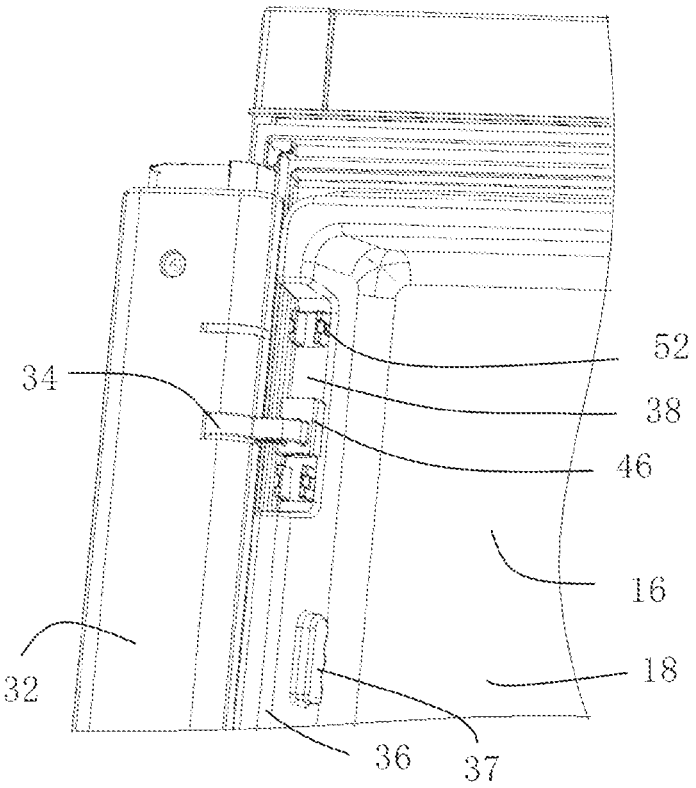
FIG. 3 is a diagrammatic local assembly diagram of the door and a turning plate of the refrigerator in FIG. 1.

As shown in FIG. 1, FIG. 2, and FIG. 3, another aspect of the embodiments of the present invention relates to a refrigerator 10, including a cabinet 12 provided with a storage compartment 14.

The refrigerator 10 includes a door 16 capable of opening and closing the storage compartment 14. The door 16 includes a liner 18, a front plate 20, and a thermal insulation material 24 at least partially located in a thermal insulation space 22 between the front plate 20 and the liner 18.

The door 16 may include a reinforcement member 26. The reinforcement member 26 extends along an inner side 28 of the liner 18 facing the thermal insulation space 22. The reinforcement member 26 may include a first connection portion 30 protruding out of the liner 18.

The refrigerator 10 includes a turning plate 32, connected to the door 16. The turning plate 32 is rotatably connected to the door 16 to seal a gap between the door 16 and another door (not shown) adjacent to the door 16.

The refrigerator 10 includes a connection assembly 34, connected to the turning plate 32 and the door 16. The connection assembly 34 is connected to the first connection portion 30.

The refrigerator 10 may be of any suitable type. The cabinet 12, the storage compartment 14, and the door 16 may include any suitable shape and configuration, etc. More than two doors 16 may exist and may be disposed side by side. FIG. 1 omits the door at the right side (not shown) to more clearly present a position relation between the door 16 and the turning plate 32. In the refrigerator 10, leak-proofness between the adjacent doors 16 when closing the doors 16 can be improved by using the turning plate 32.

The connection assembly 34 is connected to the turning plate 32 and the first connection portion 30 of the reinforcement member 26 of the door 16, which facilitates improving the assembly accuracy between the turning plate 32 and the door 16, and moreover also facilitates reducing the assembly complexity.

The liner 18 and the first connection portion 30 may be configured with each other in any suitable manner. In some embodiments, when closing the door 16, the liner 18 includes a protrusion portion 36 protruding towards the storage compartment 14. When the door 16 is closed, the protrusion portion 36 protrudes into the storage compartment 14. The protrusion portion 36 may be provided with a fixing structure 37 for fixing a door shelf (not shown).

The protrusion portion 36 includes a concave portion 38 facing the storage compartment 14 and denting in a direction away from the storage compartment 14, and the first connection portion 30 protrudes into the concave portion 38.

The first connection portion 30 protrudes into the concave portion 38 and is connected to the turning plate 32, and it is possible that a turning space required by the turning plate 32 is relatively small. When the turning space required by the turning plate 32 is reduced, it facilitates enlarging an available space of the refrigerator 10.

The reinforcement member 26 and the concave portion 38 may be configured with each other in any suitable manner. In some embodiments, on at least one cross section 40, the reinforcement member 26 has a shape adapted to the concave portion 38. In this way, it facilitates the positioning of the reinforcement member 26 with respect to the concave portion 38, so as to position the turning plate 32 with respect to the door 16, and during mounting, the assembly accuracy of the turning plate 32 and the door 16 is relatively high and the assembly difficulty is relatively small.

Figure 4:
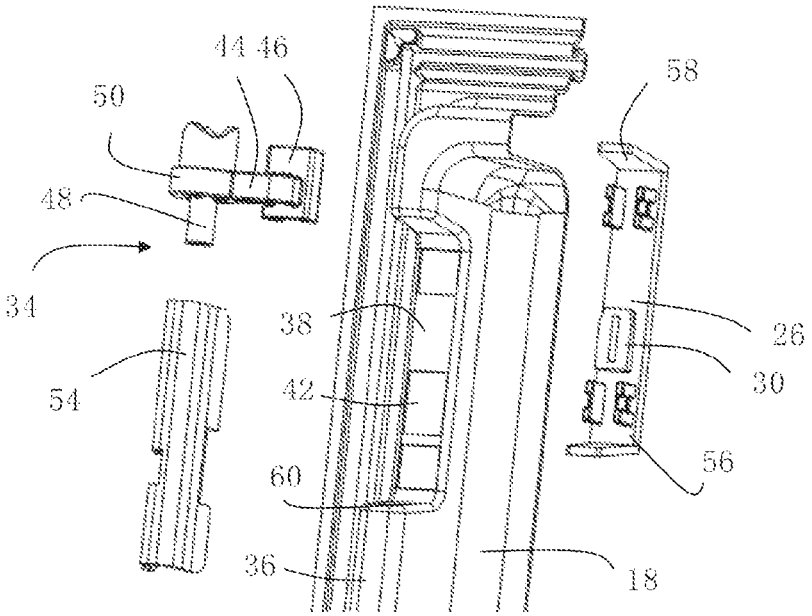
FIG. 4 is a local exploded diagrammatic view of the door of the refrigerator in FIG. 1.

The first connection portion 30 may protrude out of the liner 18 in any suitable shape and configuration. The connection assembly 34 may include any suitable shape and configuration, etc. and is connected to the first connection portion 30. Referring to FIG. 4, in some embodiments, the liner 18 includes a first window 42 exposed to the first connection portion 30, and the connection assembly 34 includes the hinge fixed member 44 fixed at the first connection portion 30. The first connection portion 30 may protrude out of the liner 18 from the first window 42 to be fixed to the hinge fixed member 44 of the connection assembly 34, which facilitates the relative positioning between the turning plate 32 and the door 16. During mounting, the assembly accuracy of the turning plate 32 and the door 16 is relatively high and the assembly difficulty is relatively small.

The first window 42 may have any suitable shape and configuration, etc., and can be adapted to the shape and configuration, etc. of the first connection portion 30. An opening direction of the first window 42 may facilitate deciding the combining direction between the first connection portion 30 and the connection assembly 34, as well as the mounting direction of the turning plate 32 with respect to the door 16. In some embodiments, the first window 42 is opened towards front and back directions. If not otherwise specified, the front and back directions in this case are indicated with respect to a user of the refrigerator 10, that is, when facing the user, the closer distance is front, and the farther distance is back. The opening of the first window 42 in the front and back directions facilitates a small turning space required by the turning plate 32, so that the available space of the refrigerator 10 is relatively large.

The hinge fixed member 44 may have any suitable shape and configuration, etc. In some embodiments, the hinge fixed member 44 has a second connection portion 46 and a third connection portion 48, the second connection portion 46 is combined with the first connection portion 30, and the third connection portion 48 is connected to the turning plate 32. The hinge fixed member 44 facilitates the connection between the door 16 and the turning plate 32.

An extension direction of the second connection portion 46 and the third connection portion 48 may facilitate deciding a relative assembly direction of the turning plate 32 and the door 16. In some embodiments, the second connection portion 46 extends parallel to the third connection portion 48. In this way, it facilitates the relatively parallel extending of the turning plate 32 and the door 16 after being assembled.

The second connection portion 46 and the third connection portion 48 may be configured with each other in any suitable shape and configuration. In some embodiments, the hinge fixed member 44 includes a middle portion 50 connecting the second connection portion 46 and the third connection portion 48. An extension direction of the middle portion 50 is different from the second connection portion 46 and the third connection portion 48. In this way, it facilitates that the second connection portion 46 and the third connection portion 48 are provided at intervals, to respectively connect the door 16 and the turning plate 32.

The middle portion 50 may extend along any suitable direction. In some embodiments, the extension direction of the middle portion 50 is different from the length direction of the liner 18. In this way, it facilitates the hinge fixed member 44 to connect the door 16 and the turning plate 32 mutually parallel in the length direction.

Figure 5:
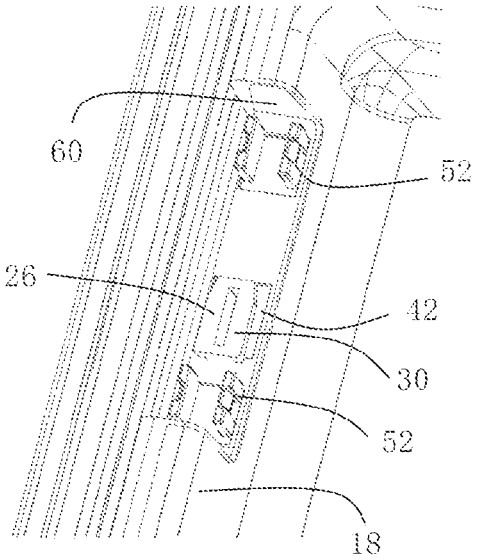
FIG. 5 is a diagrammatic local assembly view of the door of the refrigerator in FIG. 4.
Figure 6:
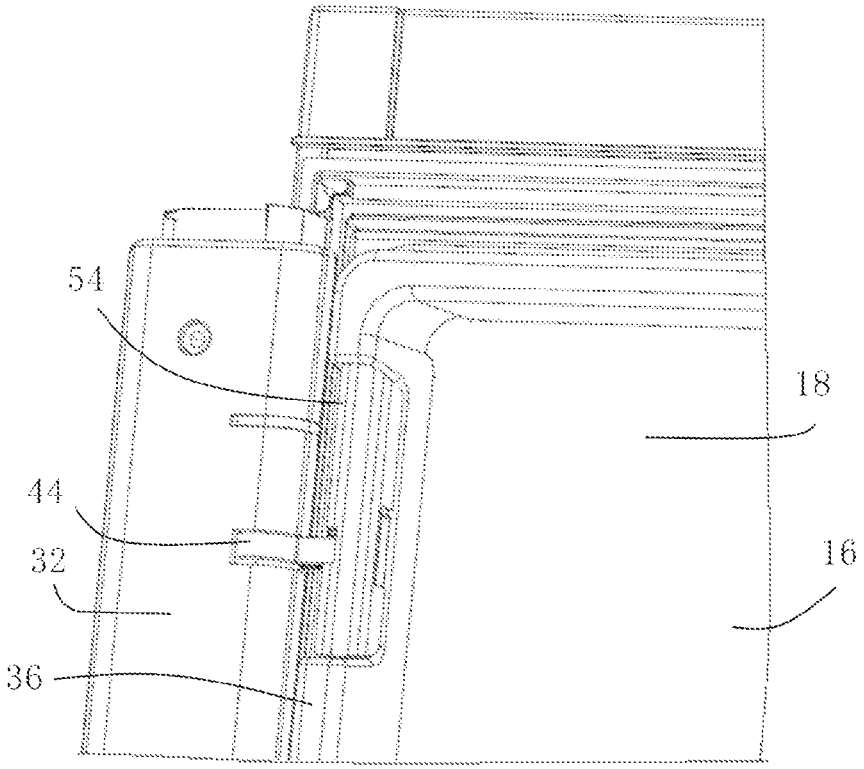
FIG. 6 is a view similar to FIG. 3, but in which a cover body is added.

The reinforcement member 26 and the connection assembly 34 may have any suitable shape and configuration, etc. for mutual matching. As shown in FIG. 5 and FIG. 6, in some embodiments, the reinforcement member 26 includes a fourth connection portion 52 protruding out of the liner 18. The connection assembly 34 includes a cover body 54 connected to the fourth connection portion 52. The cover body 54 may be adapted to the shapes and configurations, etc. of other parts of the protrusion portion 36. After the cover body 54 is connected to the fourth connection portion 52, an outer profile of the cover body 54 is equal to outer profiles of other parts of the protrusion portion 36, which facilitates the continuity of the shape of the liner 18.

The cover body 54 may match with the fourth connection portion 52 in any suitable shape and configuration, etc. In some embodiments, the cover body 54 covers the first connection portion 30 and the fourth connection portion 52. The cover body 54 may facilitate preventing the first connection portion 30 and the fourth connection portion 52 from being interfered with other parts of the refrigerator 10 and/or prevent debris and the like from falling into the concave portion 38.

There is more than one fourth connection portion 52. When there is more than one fourth connection portion 52, in some embodiments, the fourth connection portions 52 are distributed at two sides of the first connection portion 30. In this way, it facilitates the stability of the connection between the fourth connection portions 52 and the cover body 54.

The second connection portion 46 may be combined to the first connection portion 30 at any suitable angle and orientation. In some embodiments, the distance between the first connection portion 30 and the fourth connection portion 52 at a side thereof is greater than or equal to the width of the second connection portion 46. In this way, it facilitates the second connection portion 46 to move towards the first connection portion 30 from a gap between the first connection portion 30 and the fourth connection portion 52 with the distance greater than or equal to the width thereof, so as to match with the first connection portion 30.

The reinforcement member 26 may have any suitable shape and configuration differing from the aforementioned shapes and configurations. Still referring to FIG. 2, in some embodiments, the reinforcement member 26 includes a base 56 located in the thermal insulation space 22. The first connection portion 30 extends from the base 56. The base 56 may be combined with the inner side 28 of the liner 18, which facilitates the matching between the reinforcement member 26 and the liner 18, and prevents the reinforcement member 26 from departing from the liner 18.

In some embodiments, the reinforcement member 26 includes a first positioning portion 58 extending from two ends of the base 56, and the liner 18 includes a second positioning portion 60 combined with the first positioning portion 58. The combination between the first positioning portion 58 and the second positioning portion 60 may facilitate the positioning of the reinforcement member 26 with respect to the liner 18.

The reinforcement member 26 may be made of any suitable material. In some embodiments, the reinforcement member 26 is made of plastics. In this way, it facilitates the combination between the reinforcement member 26 and the liner 18.

Referring to FIG. 7, the turning plate 32 includes a first mounting portion 90 and a second mounting portion 92 opposite to the first mounting portion 90. The third connection portion 48 of the hinge fixed member 44 is abutted against the first mounting portion 90, and the hinge moving member 64 includes a third mounting portion 94 abutted against the second mounting portion 92. The first mounting portion 90 and the second mounting portion 92 may fix the mutually matched hinge moving member 64 and the hinge fixed member 44 therebetween and mount the same on the turning plate 32.

The third mounting portion 94 may extend from the second butting portion 84 in a direction opposite to an extending direction of the body portion 76, and is smaller in size than the second butting portion 84. The hinge assembly 62 includes an elastic or resilient member 96 located between the second butting portion 84 and the third mounting portion 94. The elastic or resilient member 96 may be sleeved on the third mounting portion 94. The elastic or resilient member 96 may be a spring, which facilities the mounting of the hinge assembly 62 and provides elasticity for the movement.

The various specific implementations described above and shown in the accompanying drawings are only used to illustrate the present invention, but are not all of the present invention. Any variation made by those skilled in the art to the present invention within the scope of the basic technical concept of the present invention shall fall within the protection scope of the present invention.

The invention claimed is:

1. A refrigerator, comprising:

a cabinet having a storage compartment;

a door capable of opening and closing said storage compartment;

a turning plate; and a hinge assembly including a hinge moving member and a hinge fixed member connecting said door to said turning plate, one of said hinge moving member or said hinge fixed member defining a trajectory including a first end portion and a second end portion, and another of said hinge moving member or said hinge fixed member having a limiting portion adapted to rotate between said first end portion and said second end portion along said trajectory;

one of said hinge moving member or said hinge fixed member having a receiving groove in communication with said trajectory, said other of said hinge moving member or said hinge fixed member including a body portion being internally hollow and being accommodated in said receiving groove, said limiting portion being formed in one piece with said body portion and said limiting portion protruding into said trajectory from said body portion.

2. The refrigerator according to claim 1, wherein said receiving groove includes a receiving space having a fan-shaped cross section, and said trajectory includes a limiting space having a ring-shaped cross section.

3. The refrigerator according to claim 2, wherein said first end portion and said second end portion are respectively in communication with said receiving space.

4. The refrigerator according to claim 2, wherein an outer ring diameter of said ring-shaped cross section of said limiting space is greater than a diameter of said fan-shaped cross section of said receiving space.

5. The refrigerator according to claim 1, wherein said body portion is cylindrical, and said limiting portion is a rib on said body portion.

6. The refrigerator according to claim 1, wherein one of said hinge moving member or said hinge fixed member has a first butting portion provided with said trajectory and said receiving groove, and said other of said hinge moving member or hinge fixed member has a second butting portion abutted against said first butting portion.

7. The refrigerator according to claim 6, wherein said body portion and said limiting portion extend from said second butting portion to said first butting portion.

8. The refrigerator according to claim 6, wherein said first butting portion includes a first butting surface, and said second butting portion includes a second butting surface abutted against said first butting surface.

9. The refrigerator according to claim 8, wherein said first butting surface and said second butting surface are mutually fitting curved surfaces.

10. The refrigerator according to claim 6, wherein said body portion and said limiting portion are smaller in size than said second butting portion.

11. The refrigerator according to claim 1, wherein said hinge fixed member encompasses said trajectory, and said hinge moving member includes said limiting portion.

* * * * *